US005446997A

United States Patent [19]

Simonton

[11] Patent Number: 5,446,997

[45] Date of Patent: Sep. 5, 1995

[54] OVERLAPPING AND INTERLOCKING WINDOW SASHES

[75] Inventor: Wayne S. Simonton, Parkersburg, W. Va.

[73] Assignee: SLI, Inc., Wilmington, Del.

[21] Appl. No.: 183,071

[22] Filed: Jan. 19, 1994

[51] Int. Cl.[6] ..... E05D 15/16
[52] U.S. Cl. ..... 49/458; 49/406
[58] Field of Search ..... 49/458, 406; 52/207

[56] References Cited

U.S. PATENT DOCUMENTS

| | | | |
|---|---|---|---|
| 16,800 | 11/1856 | Polachek et al. . | |
| 50,393 | 10/1865 | Shaw . | |
| 140,783 | 7/1873 | MacKay . | |
| 348,526 | 8/1886 | Longshore . | |
| 638,506 | 12/1899 | Golden . | |
| 915,445 | 3/1909 | Kammerer . | |
| 1,609,631 | 12/1926 | Rappaport . | |
| 1,927,423 | 9/1933 | Stevens et al. . | |
| 2,057,975 | 10/1936 | Plym | 49/458 |
| 3,124,850 | 3/1964 | Johnson . | |
| 4,395,847 | 8/1983 | Atchison | 49/458 X |
| 4,554,770 | 11/1985 | Anders | 49/458 X |
| 4,580,366 | 4/1986 | Hardy . | |
| 4,674,246 | 6/1987 | Giguere | 49/458 X |
| 4,726,147 | 2/1988 | Beske et al. . | |
| 4,827,685 | 5/1989 | Schmidt | 49/458 X |
| 4,831,781 | 5/1989 | Morton . | |

FOREIGN PATENT DOCUMENTS

| | | | |
|---|---|---|---|
| 1128723 | 8/1956 | France | 49/458 |

*Primary Examiner*—Philip C. Kannan
*Attorney, Agent, or Firm*—Cesari and McKenna

[57] ABSTRACT

A window assembly includes standard-sized sashes with lock and keeper rails that overlap and interlock such that adjacent sides of the rails are held in close proximity when the assembly is closed. The lock rail includes an exterior wall with an exterior edge that protrudes slightly. The keeper rail includes an interior wall with a first side, a substantially parallel second side and a top edge that extends between the two sides. The top edge includes an integral trough for receiving the protruding edge of the lock rail. When the assembly is closed, the protruding edge overlaps and interconnects with the keeper rail, such that the edge sits in the trough. The exterior wall of the lock rail is thus held in close proximity to the second side of the interior wall of the keeper rail and air flow between the rails is minimized. The rails preferably support strategically placed upper and lower gaskets, which are hidden from view when the assembly is closed. The keeper rail supports the lower gasket, which blocks air flow between the lower sections of the rails and provides a first layer of protection against air infiltration from the exterior of the structure. The lock rail supports the upper gasket and positions it directly below the protruding edge. The free end of this upper gasket rests against an upper edge of the keeper rail, and thus, against an edge of the trough, to further reduce air infiltration.

13 Claims, 2 Drawing Sheets

OVERLAPPING AND INTERLOCKING WINDOW SASHES

FIELD OF THE INVENTION

This invention relates generally to windows and more particularly to windows with interlocking sashes.

BACKGROUND OF THES INVENTION

Double hung window assemblies that open and close vertically and sliding window assemblies that open and close horizontally each have two window sashes that meet at a mid-point of the assembly when the assembly is closed. One sash typically remains stationary while the other sash moves to open the assembly. The sash that most often remains stationary, for example, the upper sash of a double hung assembly, includes as its bottom segment a rail which is commonly referred to as a "keeper" rail. The lower sash includes as its top segment a rail that is commonly referred to as a "lock" rail. When the assembly is closed, an interior wall of the keeper rail abuts an exterior wall of the lock rail. These rails are referred to collectively herein as "meeting rails."

One important feature of a window assembly is its ability to minimize air infiltration between the interior of the structure and the outside. Regardless of how tightly the meeting rails abut, air tends to flow between them. To inhibit this air flow prior known window assemblies have included interconnecting rails, which provide a labyrinth through which the air must pass.

In such assemblies, the each rail supports one of a pair of opposing flanges. When the assembly is closed, these flanges interconnect. The rails, however, must separate, to accommodate the flanges. Air flow between the rails and up to the flanges is therefore increased, and the flanges are only somewhat effective in inhibiting air flow through the separated rails.

For more protection weather-stripping gaskets may be added to either side of the flanges, to shield the interconnected flanges, as discussed in Atchison U.S. Pat. No. 4,395,847. The gaskets must be relatively thick, however, to cover the gap between the rails. Accordingly, their effectiveness in preventing air infiltration is limited. Further, these gaskets are often subjected to cleaning solvents that are used to clean the windows. These solvents tend to hasten the deterioration of the gaskets, and thus, further reduce their effectiveness.

Other prior known systems include overlapping rails, such as the system discussed in Plym U.S. Pat. No. 2,057,975. These rails are enlarged and re-shaped essentially to include opposing offsets, which overlap when the assembly is closed. These rails, like the interconnecting rails discussed above, provide a circuitous route for the air, which inhibits air flow. The enlarged rails require more material, which increases their cost of manufacture and the sash weight. These heavier sashes are more difficult: to move. i.e., to raise and lower or slide, as appropriate. Further, the window assembly that incorporates these heavier rails may require strengthening to support the sashes. In particular, a double hung assembly may require strengthening to retain the heavier sashes in an open position.

SUMMARY OF THE INVENTION

The invention is a window assembly with sashes having standard-sized rails that overlap and interlock and strategically placed gaskets to reduce significantly the air flow through the rails. The exterior edge of the lock rail protrudes slightly and overlaps the proximate edge of the keeper rail. The keeper rail includes at this edge an integral trough for receiving the protruding edge of the lock rail. When the assembly is closed, the protruding edge of the lock rail overlaps and interconnects with the proximate edge of the keeper rail, and the walls of the rails are only slightly separated. The interlocking and interconnected rails provide a narrow, obstructed air flow path, without noticeably increasing the size and/or weight of the rails, as discussed in more detail below.

Each rail supports a strategically placed, relatively thin weather-stripping gasket. The keeper rail supports a lower gasket that blocks air flow between the lower sections of the rails. This gasket provides a first layer of protection against air infiltration from the exterior of the structure. The lock rail supports an upper gasket that is positioned directly below the protruding tab. The free end of this gasket rests against the upper edge of the keeper rail, and thus, the edge of the trough. This gasket further inhibits air flow to the overlapping and interconnecting rail edges.

The thin gaskets tend to retain their shape, even after the sashes are repeatedly opened and closed. Also, they are hidden from view when the assembly is closed, since they are between the two rails. In these positions the gaskets, which are made of conventional materials, such as rubber, foam or woolpile, are protected from solvents used to clean the windows. Thus the gaskets tend to last longer than the gaskets placed above and below the interconnecting rails of prior known systems.

The rails and the strategically placed weather-stripping gaskets together render the mid-section of the window assembly air tight. The rails are essentially the same size and weight as the rails of assemblies that do not overlap or interconnect. Accordingly, the sashes that include these rails are as easily raised and lowered or moved horizontally, to open and close the assembly.

BRIEF DESCRIPTION OF THE DRAWINGS

The above and further advantages of the invention may be better understood by referring to the following description in conjunction with the accompanying drawings, in which.

DETAILED DESCRIPTION

Figure 1:
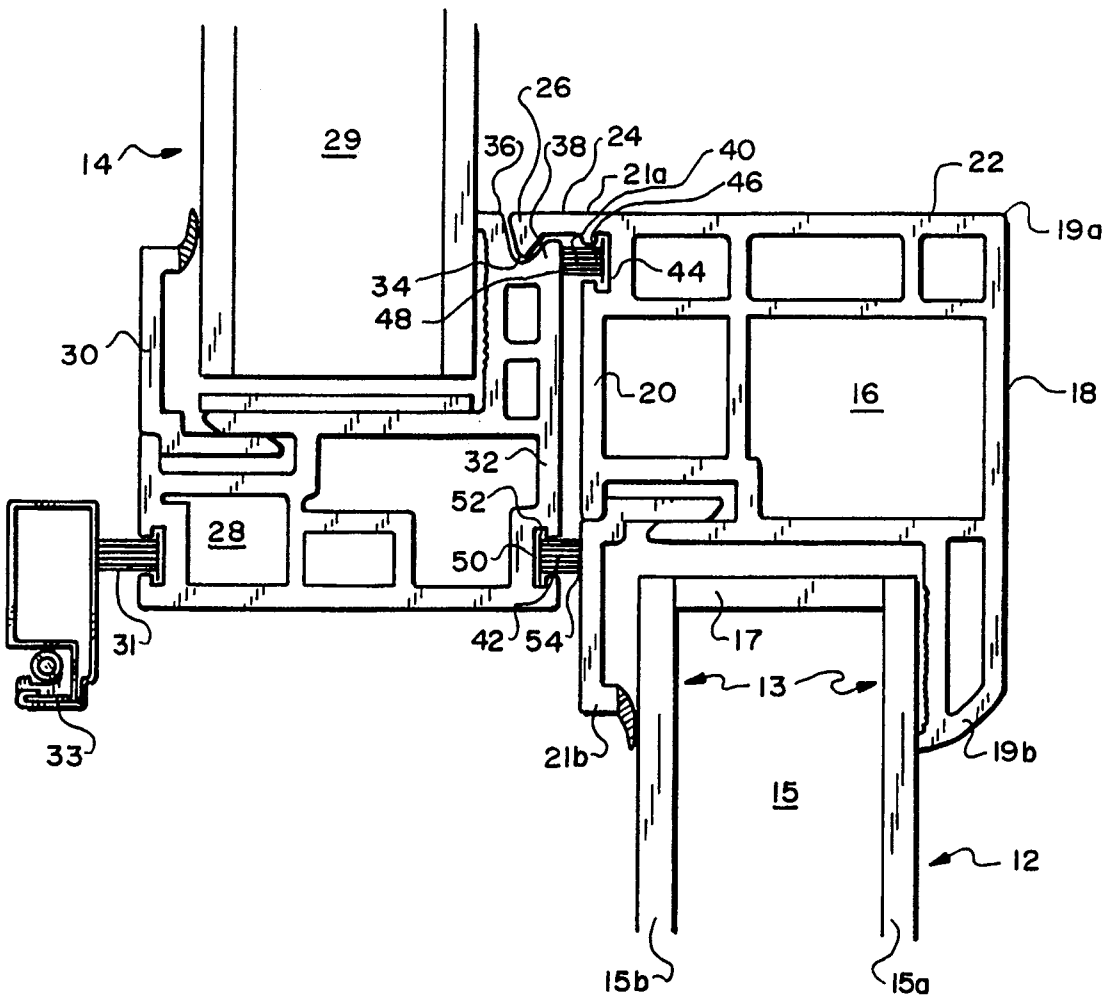
FIG. 1 depicts, in cross-section view, meeting rails of a window assembly that opens vertically.

FIG. 1 depicts, in cross-section, a double hung window assembly 10 that opens vertically. A lower sash 12 moves relative to an upper sash 14 to open and close the assembly 10. The assembly is closed in the drawing, with the top of the lower sash overlapping and interconnecting with the bottom of the upper sash to prevent air from flowing between the sashes, as discussed in more detail below. The sashes are preferably comprised of extruded plastic, i.e., vinyl, members.

The lower sash 12 includes an upper member, or lock rail, 16. The lock rail 16 has a vertical interior wall 18 and a vertical exterior wall 20 that face, respectively, the interior and the exterior of the structure (not shown) in which the window assembly 10 is installed. The bottom edges **19*b* and 21*b* of these walls 18 and 20 grip the top edge 13 of a window glass 15. The walls 18 and 20** are thus separated only by the thickness of the window glass 15, which may be, as depicted in the drawing, insulated glass which consists of two sheets of glass 15*a* and 15*b* separated by a spacer 17.

A top wall 22 connects the top edges 19*a* and 21*a* of the two vertical walls. The top wall 22 includes a protruding exterior edge 24, with a downwardly-facing shaped end 26. When the assembly 10 is closed, the protruding edge 24 overlaps and interconnects with a keeper rail 28 which is part of the upper sash 14.

The keeper rail 28 includes an exterior wall 30 and an interior wall 32 that face, respectively, the exterior and the interior of the structure (not shown). The top edges of these walls grip the bottom edge of window glass 29, and they are thus separated only by the thickness of the glass. The interior wall 32 includes at its told edge all integral, upwardly-facing trough 34 for receiving the end 26 of the protruding edge 24 of the lock rail 16.

The trough 34 has an elongated sloping exterior side 36 that turns outwardly at the told to grip the glass 29. A shorter interior side 38 directs, as lower sash descends, the end 26 of the lock rail 16 into the appropriate position within the trough. When the end 26 is within the trough 34, the interior wall 32 of the keeper rail is adjacent to the exterior wall 20 of the lock rail. To accommodate the relative movement of the sashes, the walls remain very slightly separated.

Upper and lower gaskets 40 and 42, which are supported by the rails 16 and 28 are strategically placed to inhibit air flow between the rails. These gaskets 40 and 42, as discussed in more detail below, are relatively thin and are constructed of conventional materials such as hardened rubber, closed-cell foam, hollow rubber, or woolpile.

The exterior wall 20 of the lock rail 16 includes a detent 44 which receives one end 46 of the upper gasket 40. This detent 44 is located at the top of the wall 20, directly below the protruding edge 24 of the top wall 22. The free end 48 of the upper gasket 40 rests against the top edge of the interior wall 32 of the keeper rail 28, filling in the small separation between the told edges of the two vertical walls 20 and 32 of the rails, and also the small separation between the protruding edge of the top wall 22 of the lock rail 16 and the told edge of the shorter wall 38 of the trough 34.

The upper gasket 40 and the top edges of the overlapping and interlocking rails significantly reduces air flow into or out of the structure (not shown). The upper gasket 40 also ensures that these top edges of the rails are properly positioned relative to one another, by forcing the protruding end of the lock rail into proper alignment within the trough.

As an added precaution, the lower gasket 42 is included to inhibit air flow between the two vertical walls 20 and 32 of the rails. The lower gasket 42 is supported by the interior wall 32 of the keeper rail 28. This wall 32 includes at the bottom edge a detent 50 that receives one end 52 of the gasket 42. The free end 54 of the gasket rests against the lower portion of the exterior wall of the lock rail 16. This relatively thin gasket 42 fills in the small separation between the bottom portions of the two rails and inhibits air infiltration from outside the rails.

The lower gasket 42 also maintains the proper relative alignment of the rails, and thus, ensures that the overlapping and interlocking edges of the rails and the upper gasket operate together essentially to eliminate air infiltration.

The exterior wall 30 of the keeper rail 28 supports an exterior weather-stripping gasket 31. This gasket extends between the exterior wall 30 and the window frame, a portion of which is denoted by reference numeral 33. This exterior gasket 31 is longer than either of the gaskets 40 and 42, that extend between the two rails 16 and 28.

Figure 2:
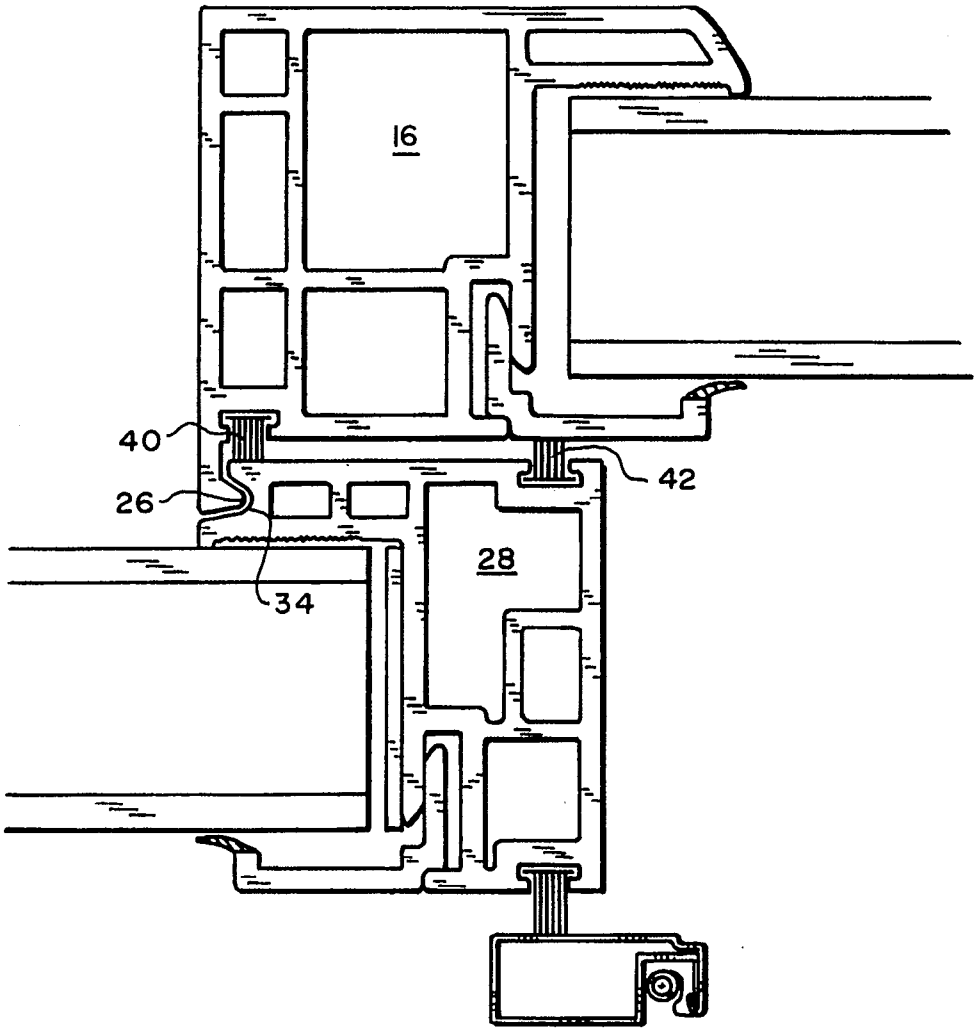
FIG. 2 depicts, in cross sectional view, the meeting rails of a window assembly that opens horizontally.

FIG. 2 depicts a window assembly 11 that is similar to the window assembly 10 of FIG. 1, except that it opens horizontally, instead of vertically. The assembly 11 includes a left and a right sash, with the right sash moving horizontally relative to the left sash, to open and close the assembly 11. The right sash includes the lock rail 16 discussed above. This rail 16 is oriented vertically with its shaped end 26 directed inwardly, toward the vertical keeper rail 28 of the left sash. These two vertically oriented rails 16 and 28 overlap and interconnect as discussed above. These rails may, instead, be part of a three sash, end-vent window. The three sash window includes two movable sashes and a center stationary sash. The stationary sash includes a keeper rail on each end. Each of the movable sashes includes a lock rail that overlaps and interconnects with the associated keeper rail.

The thin gaskets 40 and 42, which are supported by the rails, are also oriented vertically.

The overlapping and interlocking rails 16 and 28 are together no larger or heavier than rails which meet but do not interconnect or overlap. The lock rail 16 includes an integral protruding edge, which requires a small addition to the rail. It does not, however, require additional assembly. As discussed above, these rails are preferably extruded, and thus, the protruding edge is readily incorporated into the rail and the weight added by this edge is minimal.

The keeper rail is preferably extruded, also. The integral trough reduces the materials required to manufacture the rail and reduces the weight of the rail. Accordingly, the assembly with both the keeper and the lock rail weighs essentially the same as an assembly with extruded rails that do not overlap or interlock, and the increase in material required for the lock rail is offset by the reduction in material required for the keeper rail.

The placement of the gaskets between the upper and lower edges of the rails not only provides an air-tight assembly, it produces an aesthetically pleasing assembly. When the assembly is closed, the gaskets are not visible, from either the interior or the exterior of the structure. Further, these gaskets, which are rubber closed-cell foam, woolpile, etc., are shielded by the overlapping and interlocking rail edges, and thus, they will not be subjected to window cleaning solvents, which may otherwise cause them to deteriorate. In prior known systems, a gasket is positioned above the rails, where it is not so shielded. In these prior systems, the gaskets are thicker than the gaskets 40 and 42. Accordingly, these thicker gaskets must be more pliable, so that they do not interfere with the movement of the sashes. The pliable gaskets tend to lose their shape more quickly and require replacement more often than the thin gaskets 40 and 42.

The foregoing description has been limited to a specific embodiment of this invention. It will be apparent, however, that variations and modifications may be made to the invention, with the attainment of some or all of its advantages. Therefore, it is the object of the appended claims to cover all such variations and modifications as come within the true spirit and scope of the invention.

What is claimed is:

1. A window assembly having an open position and a closed position, the window assembly including:

A. an upper sash comprising an upper window and surrounding rails including a bottom rail, each rail having essentially the same overall thickness and having an exterior wall and an interior wall that grip the upper window, the interior wall having (i) a first side that is proximate to the upper window, (ii) a second side that is essentially parallel to the first side, and (iii) the interior wall of said bottom rail having a top edge disposed between the first and second sides, the top edge including an integral trough; and B. a lower sash including a top rail having an interior wall and an exterior wall that grip a lower window and a top wall that connects the interior and exterior walls, the top wall having a protruding exterior edge with an end piece shaped to mate with the trough of the upper sash, such that the top rail of the lower sash overlaps and interconnects with the bottom rail of the upper sash when the window assembly is in the closed position, and the exterior wall of the top rail and the second side of the interior wall of the bottom rail are adjacent to each other.

2. The window assembly of claim 1 further including:

C. an upper gasket having a top, a bottom, a first end and a second end with the first end of the upper gasket being supported by the exterior wall of the lower sash and positioned directly underneath the protruding top edge of the sash and the second end of the upper gasket resting against the interior wall of the upper sash, with the top of the upper gasket meeting the top edge of the interior wall of the upper sash; and D. a lower gasket having a top, a bottom, a first end and a second end with the first end of the lower gasket being supported by the interior wall of the upper sash and positioned directly above a bottom edge of the wall and the second end resting against the exterior wall of the lower sash;

wherein the upper gasket inhibits air flow to the interlocking and interconnecting top edges of the rails and the lower gasket inhibits air flow between the exterior wall of the top rail of the lower sash and the interior wall of the bottom rail of the upper sash.

3. The window assembly of claim 1 further including an upper gasket having a top, a bottom, a first end and a second end with the first end of the upper gasket being supported by the exterior wall of the top rail and positioned directly underneath the protruding top edge and the second end of the upper gasket resting against the interior wall of the bottom rail, with the top of the upper gasket meeting the top edge of the rail, the upper gasket properly aligning the upper and lower sashes when the window assembly is in the closed position, to inhibit air flow between the top and bottom rails.

4. The window assembly of claim 3 further including a lower gasket having a top, a bottom, a first end and a second end with the first end of the lower gasket being supported by the interior wall of the bottom rail and positioned directly above a bottom edge of the rail and the second end resting against the exterior wall of the top rail, the lower gasket properly aligning the upper and lower sashes when the window assembly is in the closed position, to inhibit air flow between the rails.

5. A window assembly having two sashes that meet when the window assembly is in a closed position, the window assembly including:

A. a first sash comprising an associated first window and surrounding rails including a first meeting rail, each rail having essentially the same overall thickness and having an exterior wall and an interior wall that grip the associated first window, the interior wall having (i) a first side that is proximate to the associated first window, (ii) a second side that is essentially parallel to the first side, and (iii) the interior wall of said meeting rail having an edge disposed between the first and second sides, the edge including an integral trough; and B. a second sash comprising an associated second window and surrounding rails including a second meeting rail, each rail having essentially the same overall thickness and having an interior wall and an exterior wall that grip the associated second window, the meeting rail further including a connecting wall that connects the interior and exterior walls, the connecting wall having a protruding edge with an end piece shaped to mate with the trough of the first sash, such that the second meeting rail overlaps and interconnects with the first meeting rail when the window assembly is in the closed position, and the exterior wall of the second meeting rail and elongated second side of the interior wall of the first meeting rail are adjacent to each other.

6. The window assembly of claim 5, wherein the first and second meeting rails are oriented vertically.

7. The window assembly of claim 5 further including:

C. a first gasket having a top, a bottom, a first end and a second end with the first end of the first gasket being supported by the interior wall of the first meeting rail, the first gasket being positioned directly adjacent to one edge of the exterior wall with the second end resting against the exterior wall of the second meeting rail; and D. a second gasket having a top, a bottom, a first end and a second end with the first end of the second gasket being supported by the exterior wall of the second meeting rail, the second gasket being positioned directly adjacent to the protruding edge of the second meeting rail and the second end of the second gasket resting against the interior wall of the first meeting rail, with the top of the second gasket meeting the edge of the interior wall of first meeting rail that supports the trough;

wherein the second gasket inhibits air flow to the interlocking and interconnecting edges of the meeting rails and the first gasket inhibits air flow between the exterior wall of the first meeting rail and the interior wall of the second meeting rail.

8. The window assembly of claim 7, wherein the first and second meeting rails and the first and second gaskets are oriented vertically.

9. The window assembly of claim 5 further including a first gasket having a top, a bottom, a first end and a second end with the first end of the first gasket being supported by the exterior wall of the second meeting rail, the first gasket being positioned directly adjacent the protruding edge of the second meeting rail and the second end of the first gasket resting against the interior wall of the first meeting rail, with the top of the first gasket meeting the edge of the interior wall of first meeting rail that supports the trough, the first gasket properly aligning the first and second sashes, to inhibit air flow between the rails.

10. The window assembly of claim 9 further including a second gasket having a top, a bottom, a first end and a second end with the first end of the second gasket being supported by the interior wall of the first meeting rail, the second gasket being positioned directly adjacent to one edge of the interior wall with the second end resting against the exterior wall of the second meeting rail, the second gasket properly aligning the first and second sashes when the window assembly is in the closed position, to inhibit air flow between the rails.

11. A window assembly having an open position and a closed position, the window assembly including:

A. first sash including a first meeting rail with an exterior wall and an interior wall that grip an associated window, the interior wall having on one edge a trough and on an opposite edge a detent;

B. a first gasket having a first end and a second end, the first end of the first gasket fitting into the detent on the interior wall of the first meeting rail;

C. a second sash including a second meeting rail with an interior wall and an exterior wall that grip an associated window and a connecting wall that connects the interior and exterior walls, the connecting wall having a protruding edge with an end piece shaped to mate with the trough in the first meeting rail, the exterior wall having a detent directly below the protruding edge; and D. a second gasket having a first end, a second end, a top and a bottom, the first end of the second gasket fitting into the detent on the exterior wall of the second meeting rail, wherein the second meeting rail overlaps and interconnects with the first meeting rail when the window assembly is in the closed position, such that the exterior wall of the second meeting rail and the interior wall of the first meeting rail are adjacent and separated by a minimum distance and the second end of the first gasket rests against a bottom portion of the second meeting rail and the second end of the second gasket rests against the first meeting rail directly below the trough.

12. A window assembly having an open position and a closed position, the window assembly including:

A. an upper sash including a bottom rail with an exterior wall and an interior wall that grip an upper window, the interior wall having on a top edge a trough;

B. a lower sash including a top rail with an interior wall and an exterior wall that grip a lower window and a top wall that connects the interior and exterior walls, the top wall having a protruding exterior edge with an end piece shaped to mate with the trough of the upper sash, the top rail of the lower sash overlapping and interconnecting with the bottom rail of the upper sash when the window assembly is in the closed position, such that the exterior wall of the top rail of the lower sash and the interior wall of the bottom rail of the upper sash are adjacent and separated by a minimum distance;

C. an upper gasket having a top, a bottom, a first end and a second end with the first end of the upper gasket being supported by the exterior wall of the lower sash and positioned directly underneath the protruding top edge of the sash and the second end of the upper gasket resting against the interior wall of the upper sash, with the top of the upper gasket meeting the top edge of the interior wall of the upper sash; and D. a lower gasket having a top, a bottom, a first end and a second end with the first end of the lower gasket being supported by the interior wall of the upper sash and positioned directly above a bottom edge of the wall and the second end resting against the exterior wall of the lower sash;

wherein the upper gasket inhibits air flow to the interlocking and interconnecting top edges of the rails and the lower gasket inhibits air flow between the exterior wall of the top rail of the lower sash and the interior wall of the bottom rail of the upper sash.

13. A window assembly having an open position and a closed position, the window assembly including:

A. first sash including a first meeting rail with an exterior wall and an interior wall that grip an associated window, the interior wall having on one edge a trough;

B. a second sash including a second meeting rail with an interior wall and an exterior wall that grip an associated window and a connecting wall that connects the interior and exterior walls, the connecting wall having a protruding edge with an end piece shaped to mate with the trough of the first sash, the second meeting rail overlapping and interconnecting with the first meeting rail when the window assembly is in the closed position, such that the exterior wall of the second meeting rail and the interior wall of the first meeting rail are adjacent and separated by a minimum distance;

C. a first gasket having a top, a bottom, a first end and a second end with the first end of the first gasket being supported by the interior wall of the first meeting rail, the first gasket being positioned directly above a bottom edge of the interior wall with the second end resting against the exterior wall of the second meeting rail; and D. a second gasket having a top, a bottom, a first end and a second end with the first end of the second gasket being supported by the exterior wall of the second meeting rail, the second gasket being positioned directly underneath the protruding edge of the second meeting rail and the second end of the second gasket resting against the interior wall of the first meeting rail, with the top of the second gasket meeting the top edge of the interior wall of first meeting rail;

wherein the second gasket inhibits air flow to the interlocking and interconnecting edges of the meeting rails and the first gasket inhibits air flow between the exterior wall of the first meeting rail and the interior wall of the second meeting rail.

* * * * *